United States Patent [19]

Rossini

[11] 4,122,794

[45] Oct. 31, 1978

[54] LIGHTWEIGHT ANCHOR RAIL MOUNT

[76] Inventor: Alfred P. Rossini, 6 Belmore Rd., Framingham, Mass. 01701

[21] Appl. No.: 746,098

[22] Filed: Dec. 1, 1976

[51] Int. Cl.[2] ..... B63B 21/22

[52] U.S. Cl. ..... 114/210; 114/221 R

[58] Field of Search ..... 114/221 R, 210, 294, 114/301, 304, 310; 24/73 AS, 81 CR; 248/227, 309 R, 317, 340; 403/397, 400, 385

[56] References Cited

U.S. PATENT DOCUMENTS

| | | | |
|---|---|---|---|
| 604,775 | 5/1898 | Monteer | 403/400 |
| 1,835,338 | 12/1931 | Rossman | 403/385 |
| 2,626,770 | 1/1953 | Norman | 248/309 R |
| 2,855,107 | 10/1958 | Roth | 248/309 X |
| 3,752,107 | 8/1963 | Van Tuyl | 114/210 |

*Primary Examiner*—Robert B. Reeves
*Assistant Examiner*—Edward M. Wacyra
*Attorney, Agent, or Firm*—Irving M. Kriegsman

[57] ABSTRACT

A device for mounting a lightweight anchor on the rail of a boat. The device is made up of a base, a pair of hooks and a clamp. The hooks are attached to the base and extend vertically downward from the base. The clamp is attached to the top of the base. The device is mounted on the rail by means of the clamp and is positioned such that one of the hooks is lower than the other hook. In use, the shank of the anchor is seated on the two hooks.

4 Claims, 1 Drawing Figure

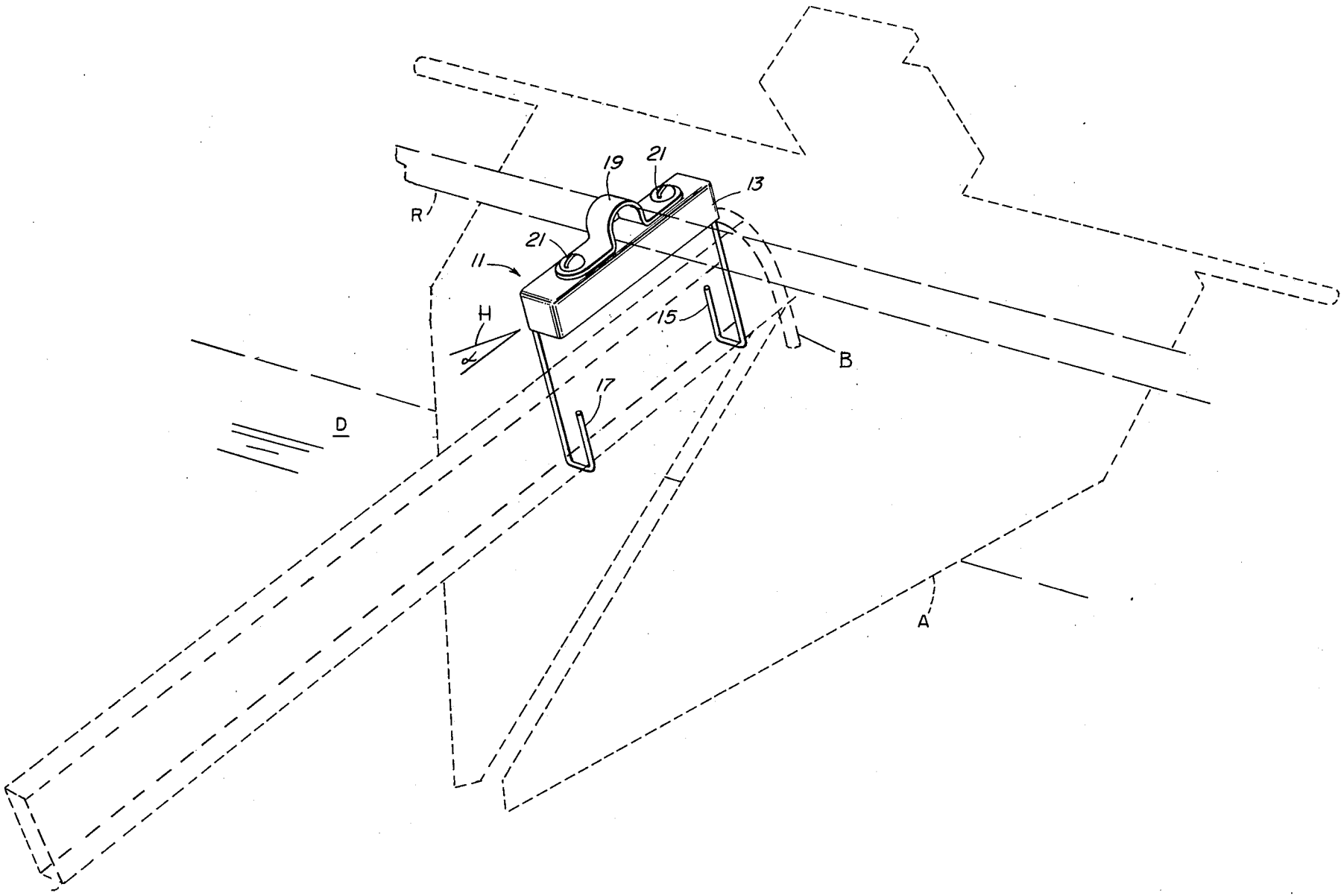
A
B
13
15
21
19
17
21
11
H
α
R
D

LIGHTWEIGHT ANCHOR RAIL MOUNT

BACKGROUND OF THE INVENTION

This invention relates to lightweight anchors. More particularly, this invention relates to a device for mounting a lightweight anchor on the rail of a boat.

A lightweight anchor is a type of marine anchor that is well known in the art and widely used with boats of all sizes. The component parts of a lightweight anchor include a stock, a crown, a pair of flukes which are fixed relative to the crown and a shank which is mounted for pivotal movement relative to the flukes. In my copending patent application Ser. No. 746,100, filed concurrently with this patent application, the subject matter of which patent application is incorporated herein by reference, there is described one type of lightweight anchor construction. Other examples of lightweight anchors can be found in U.S. Pat. Nos. 3,780,688; 3,782,318; and 3,783,815.

When not being used, lightweight anchors are usually either stashed away underneath the deck, secured to the top of the deck or attached to some part of the boat, such as the rail. Hitherto, lightweight anchors have been mounted on the rail using a pair of metal straps, one of the straps having a hole and the other strap having a slot. The straps are secured to the rail and the anchor is mounted on the straps by inserting one end of the stock into the hole and then dropping the stock on the other side of the flukes into the slot. One of the disadvantages of this type of mount is that the stock is free to rotate within the hole and slot about its own longitudinal axis. This results in an undesirable swaying or pendulum type movement of the flukes, even under mild sea conditions. To prevent this rotation the flukes must be lashed down. Another disadvantage of this type of mount is that the shank is also free to swing back and forth in a pendumum type movement since it is pivotally mounted relative to the stock. To prevent such rotation, the shank must be tied down.

SUMMARY OF THE INVENTION

It is an object of this invention to provide a new and improved device for mounting a lightweight anchor on the rail of a boat.

It is another object of this invention to provide a lightweight anchor rail mount that is easy to construct, easy to install and easy to use.

It is still another object of this invention to provide a new and improved technique for mounting a lightweight anchor on the rail of a boat.

It is yet still another object of this invention to provide a device for mounting a lightweight anchor on the rail of a boat such that the shank of the anchor is not free to pivot and rotational movement of the flukes is reduced to a minimum.

A lightweight anchor rail mount constructed according to this invention includes a base, a pair of J-shaped hooks rigidly secured to the base and a clamp for attaching the base to the rail of the boat. The two hooks are disposed in parallel planes, aligned with one another so that the hook positions of the two hooks define a slot but with the legs reversed. The mount is attached to the rail so that one of the hooks is lower than the other. The mount is used by placing the shank of the anchor between the hooks, turning the shank until it is aligned over the slot defined by the two hooks, lowering the shank into the slot defined by the hook portions of the two hooks, and then moving the shank along its axis in the direction of the lower hook until the main body portion of the anchor abuts up against the higher positioned hook.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which like reference numerals or characters represent like parts and wherein:

The sole FIGURE is a perspective view of a lightweight anchor rail mount constructed according to this invention, mounted on the rail of a boat and holding a lightweight anchor.

DESCRIPTION OF PREFERRED EMBODIMENT

Referring now to the drawing, there is shown a lightweight anchor rail mount constructed according to this invention and identified generally by reference numeral 11.

Mount 11 includes a base 13, a pair of hooks 15, 17 and a clamp 19.

Base 13 is in the shape of a rectangular open-bottom box and is made out of stainless steel plate stock. Hooks 15 and 17 are J-shaped and are welded to diagonal corners of the base 13, extend down from base 13 and are arranged so that the hook portions are aligned with one another and in parallel planes. The legs of the hook portions of each hook are straight and parallel to each other. Hooks 15 and 17 are made out of stainless steel bar stock. Clamp 19 is attached to the top of base 13 by means of screws 21 which fit into holes (not shown) in the base 13 and is also made out of stainless steel.

Mount 11 is attached to the rail R of a boat by means of clamp 19 and is tilted about the rail R at an angle $\alpha$ with the horizontal H so that one of the hooks 15 is higher than the other hook 17. Preferably, the mount 11 is tilted down towards the deck D and the angle of tilt is about 30° to 45°.

Anchor A is mounted in mount 11 by placing the shank of the anchor A between the two hooks 15, 17 then turning the shank about an axis perpendicular to its longitudinal axis until it is positioned just above the slot defined by hook portions of the two J hooks 15, 17. The shank is then lowered down into the slot defined by hook portions of the two hooks 15, 17 and is then slid forward in the direction of the lower hook 17 until the body of the anchor A abuts up against the back of the higher hook 15. The part of the anchor A that the higher hook 15 will abut against depends on the anchor construction. In the anchor construction in my copending application Ser. No. 746,100 the hook wil abut against the U-brace B connected between the flukes. In most other lightweight anchor constructions the crown of the anchor will abut on the hook.

The anchor mount constructed according to this invention has several advantages over the two strap type mount. Firstly, since it supports the shank rather than the stock, the shank is not free to swing. Secondly, since the shank in most all lightweight anchors is either rectangular or flattened oval in cross-section and not circular in cross-section like the stock, and the legs of the hooks are parallel, the shank will not be able to rotate about its own longitudinal axis when it is seated in the mount. Thirdly, when seated in the mount, the flukes are directed down and hitting against the angle stops and are only free to swing in an upward direction against the forces of gravity. Consequently, there will be no pendulum type of rotation.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A lightweight anchor rail mount comprising:
(a) a base,
(b) a pair of hooks rigidly secured to the base, and
(c) means for securing the base to a rail
(d) said hooks being J shaped and disposed in parallel planes, spaced apart and aligned with each other, the hook portions of the two hooks defining a slot for receiving and holding a lightweight anchor, the legs of the two hooks being reversed relative to each other, the hooks extending downward from the base and being welded thereto, the base being in the shape of a rectangular open-bottomed box.

2. The invention of claim 1 and wherein the clamp means for securing the base to a rail is semicircular and is removably attached on the top of the base.

3. The invention of claim 2 and wherein the legs of the hooks are generally parallel.

4. The invention of claim 3 and wherein the base, the hooks and the clamp are made of stainless steel.

* * * * *